US011578563B2

(12) United States Patent
Howitt

(10) Patent No.: US 11,578,563 B2
(45) Date of Patent: Feb. 14, 2023

(54) JETTING DEVICE FOR WELLBORE ANNULUS

(71) Applicant: Halliburton Energy Services, Inc., Houston, TX (US)

(72) Inventor: Garry M. Howitt, Midmar (GB)

(73) Assignee: Halliburton Energy Services, Inc., Houston, TX (US)

( * ) Notice: Subject to any disclaimer, the term of this patent is extended or adjusted under 35 U.S.C. 154(b) by 600 days.

(21) Appl. No.: 16/497,648

(22) PCT Filed: Dec. 4, 2018

(86) PCT No.: PCT/US2018/063807

§ 371 (c)(1),
(2) Date: Sep. 25, 2019

(87) PCT Pub. No.: WO2020/117210

PCT Pub. Date: Jun. 11, 2020

(65) Prior Publication Data

US 2021/0332671 A1 Oct. 28, 2021

(51) Int. Cl.
*E21B 37/00* (2006.01)
*B08B 9/04* (2006.01)

(52) U.S. Cl.
CPC ..... *E21B 37/00* (2013.01); *B08B 9/04* (2013.01)

(58) Field of Classification Search
CPC ..... E21B 37/00; B08B 9/04
See application file for complete search history.

(56) References Cited

U.S. PATENT DOCUMENTS 5,533,571 A * 7/1996 Surjaatmadja ..... E21B 37/00 166/318
5,765,756 A 6/1998 Jordan et al.
6,651,744 B1 * 11/2003 Crawford ..... E21B 17/1057 166/311
8,752,651 B2 6/2014 Randall et al.
(Continued)

FOREIGN PATENT DOCUMENTS

GB 2468972 5/2011
WO 2010047708 4/2010

OTHER PUBLICATIONS

Ali et al., "Integrated Wellbore Cleanout Systems—Improving Efficiency and Reducing Risk", Oilfield Review Summer 2005, pp. 1-10.

(Continued)

*Primary Examiner* — Douglas Lee
(74) *Attorney, Agent, or Firm* — Kilpatrick Townsend & Stockton LLP

(57) ABSTRACT

A tubular jetting device includes at least one inlet port that includes a first inlet opening in an inner surface of the tubular jetting device where the inner surface defines a center bore. The at least one inlet port also includes a second inlet opening in an end surface of the tubular jetting device and an inlet channel extending between the first inlet opening and the second inlet opening. The tubular jetting device further includes at least one exhaust port that includes a first exhaust opening in the end surface, a second exhaust opening in an outer surface of the tubular jetting device, and an exhaust channel extending between the first exhaust opening and the second exhaust opening.

13 Claims, 5 Drawing Sheets

(56) References Cited

U.S. PATENT DOCUMENTS

| | | | | |
|---|---|---|---|---|
| 2002/0117305 | A1 | 8/2002 | Calder et al. | |
| 2007/0017679 | A1* | 1/2007 | Wolf | E21B 34/14 166/174 |
| 2009/0032247 | A1 | 2/2009 | Davis | |
| 2011/0110726 | A1 | 5/2011 | Plahert | |
| 2011/0214872 | A1* | 9/2011 | Crawford | B08B 9/0557 166/99 |
| 2014/0196954 | A1 | 7/2014 | Mahmood et al. | |
| 2016/0123116 | A1* | 5/2016 | Randle | E21B 21/01 166/243 |
| 2018/0238143 | A1 | 8/2018 | Falk et al. | |

OTHER PUBLICATIONS

International Application No. PCT/US2018/063807 , "International Search Report and Written Opinion", dated Aug. 26, 2019, 11 pages.

* cited by examiner

JETTING DEVICE FOR WELLBORE ANNULUS

TECHNICAL FIELD

The present disclosure relates to a jetting device for use in wellbore drilling operations. More specifically, this disclosure relates to a jetting device for washing specific annular void areas.

BACKGROUND

During drilling operations, minerals and other deposits may build up in a wellbore casing and a downhole assembly operating in a wellbore. Examples of minerals and other depositions can include sand, barite settlement, and heavy fluids or gels. The minerals and other deposits may slow production and result in malfunctioning of machinery downhole. The wellbore can be cleaned to remove the minerals and other depositions, but tools and devices to do so circulate a fluid to clean the wellbore, and the circulating fluid typically lacks the control to clean targeted areas within the wellbore.

DETAILED DESCRIPTION

Figure 1:
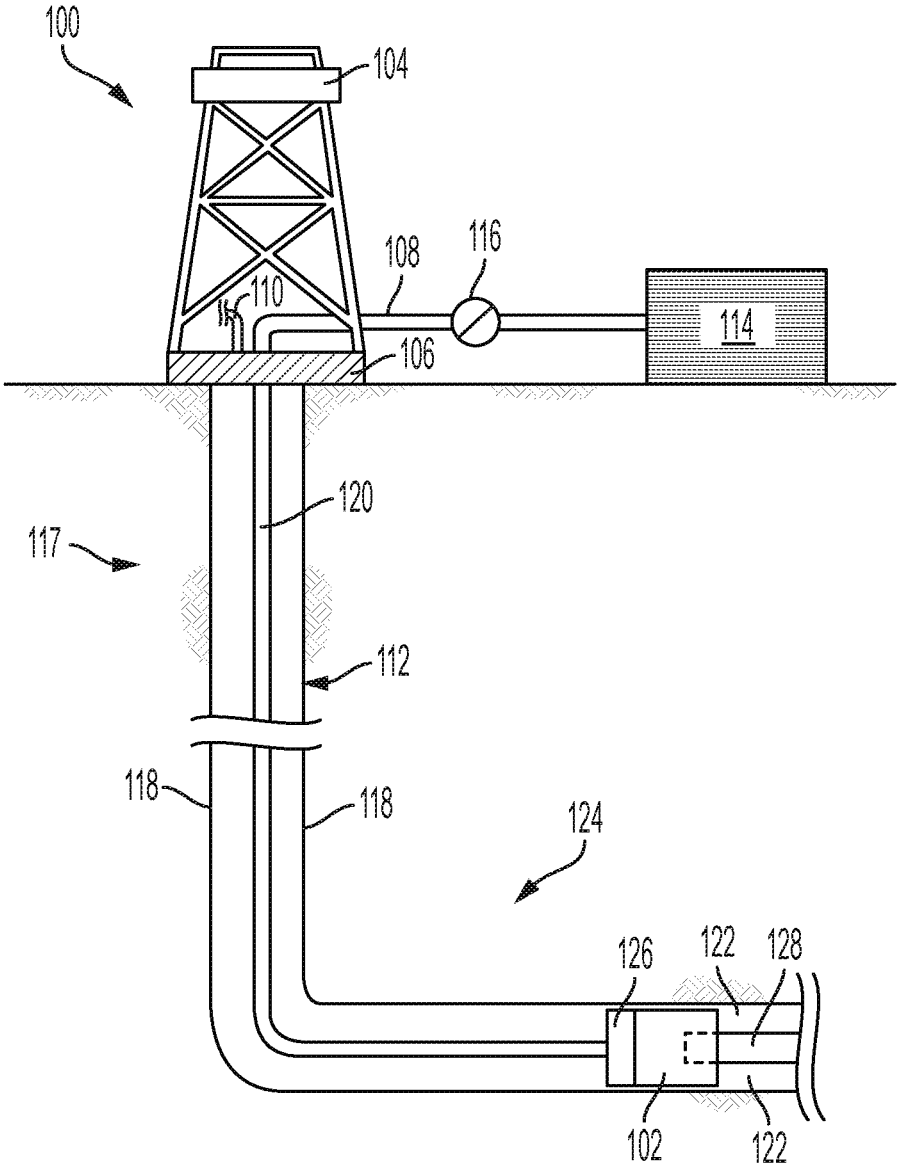
FIG. 1 is a cross-sectional view of an example of a well system that includes a tubular jetting device according to some aspects of the present disclosure.

Certain aspects and examples of the disclosure relate to tubular jetting devices used to clean debris from an annular space downhole within a wellbore. The annular space may be the space surrounding one cylindrical object placed inside another. For example, the annular space may be the space surrounding a tubular object positioned within a wellbore.

The tubular jetting device, or tubular jetting device, may be attached to a downhole end of a work string and become part of the work string tip. The tubular jetting device may include a ported jet portion, such as a ported jet sub, which may allow a circulated fluid to exit the tubular jetting device through the work string tip and through at least one second inlet opening, such as outlet ports, when no obstruction is in a center bore of the tubular jetting device or the work string. The tubular jetting device may also include the ability to divert the flow of the circulated fluid to jet a specific area and take returns up through the tubular jetting device into an annular space between the work string and the casing or wellbore wall. For example, when the tubular jetting device is moved over a downhole assembly, the downhole assembly may be accepted into the center bore of the work string or the tubular jetting device and the main flow of the circulated fluid may be at least partially directed through the outlet ports. This flow of the circulated fluid through the outlet ports may enable a diversion of the main flow of the circulated fluid to the annular area around the downhole assembly in the wellbore, more specifically to targeted circulation points, to wash a specific annular void area, or annular space, of fine debris.

The tubular jetting device may include at least one second set of return ports, such as a first exhaust opening and a second exhaust opening, that allow the flow of the circulated fluid to return through and exit the tubular jetting device into the annular area uphole from the tubular jetting device.

Further, the tubular jetting device may include an exhaust port, such as an exhaust port sub, at an opposite end (e.g., an uphole end) of the tubular jetting device from an end that includes the ported jet sub. The debris-laden fluid may exit the ports, such as the second exhaust openings, of the exhaust port sub into the annular space to be circulated upwards and out of the wellbore hole.

Additionally, the tubular jetting device may also include an extension portion, such as a seal collar extension sub, incorporated into the tubular jetting device between the ported jet sub and the exhaust port sub. A number of these extension portions can be run to extend the tubular jetting device and may permit longer downhole assemblies to be washed over. A seal ring may be added to an inner diameter of any one or more of these components (e.g., the ported jet sub, the exhaust port sub, and the seal collar extension sub) to allow the flow of the circulated fluid to be more efficiently diverted through the jet ports.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure, FIG. 1 is a cross-sectional view of an example of a well system 100 that includes a tubular jetting device 102 according to some aspects. While FIG. 1 generally depicts a land-based well system, similar systems may be operated in subsea well systems. The well system 100 may include a derrick 104 positioned over a wellhead 106. The wellhead 106 may receive a number of lines 108 and 110 to provide hydraulic access to a wellbore 112. For example, a high-pressure line 108 is depicted along with a production line 110.

The high-pressure line 108 may be in fluid communication with a mixing tank 114, in which cleaning liquids may be mixed or stored for insertion into a work string 120. A pump 116 may pump the cleaning liquids into the work string 120 during a cleaning operation. The production line 110 may be used to produce fluids from within the wellbore 112 to the surface. The fluids produced using the production line 110 may be hydrocarbon fluids from a formation 117 surrounding the wellbore 112 or debris-laden fluids produced after a cleaning operation is completed.

Further, in an example, the wellbore 112 includes a casing 118. The casing 118 may extend for a length of the wellbore 112, and the casing 118 may help support the stability of the wellbore 112. Further, the casing 118 may include a pipe that is cemented in place within the wellbore 112.

As depicted in FIG. 1, the wellbore 112 traverses the formation 117 before reaching a production region 124. The tubular jetting device 102 may be deployed to various locations in the wellbore 112 using a variety of methods. In an example, the tubular jetting device 102 may be attached to the work string 120 for deployment of the tubular jetting device 102 in the wellbore 112. In one or more examples, the work string 120 may include a string of jointed pipe, transmission tubing, or coiled tubing joined with the tubular jetting device 102 and used to deploy the tubular jetting device 102. In such an arrangement, the tubular jetting device 102 may be attached to the work string 120, or any other piping or tubing, via a threaded connection. However, it may be understood that the tubular jetting device 102 may be attached using any suitable type of connection. Additionally, the work string 120 may transmit a liquid from the mixing tank 114 to the tubular jetting device 102.

When deployed, the tubular jetting device 102 may be used at any location throughout the wellbore 112. For example, with the tubular jetting device 102 deployed as depicted in FIG. 1, the tubular jetting device 102 may be positioned to accept a downhole assembly 128 that is in use in the wellbore. Positioning of the downhole assembly 128 within the tubular jetting device 102 may enable cleaning operations to be focused on an annulus 122 between the downhole assembly 128 and the casing 118 or a wall of the wellbore 112. Thus, targeted circulation of cleaning fluids in certain areas of the annulus 122 may be accomplished. As used herein, the term downhole assembly 128 may refer to drill string, downhole tools, wellbore cleaning tools, and wellbore fishing assemblies.

Figure 2:
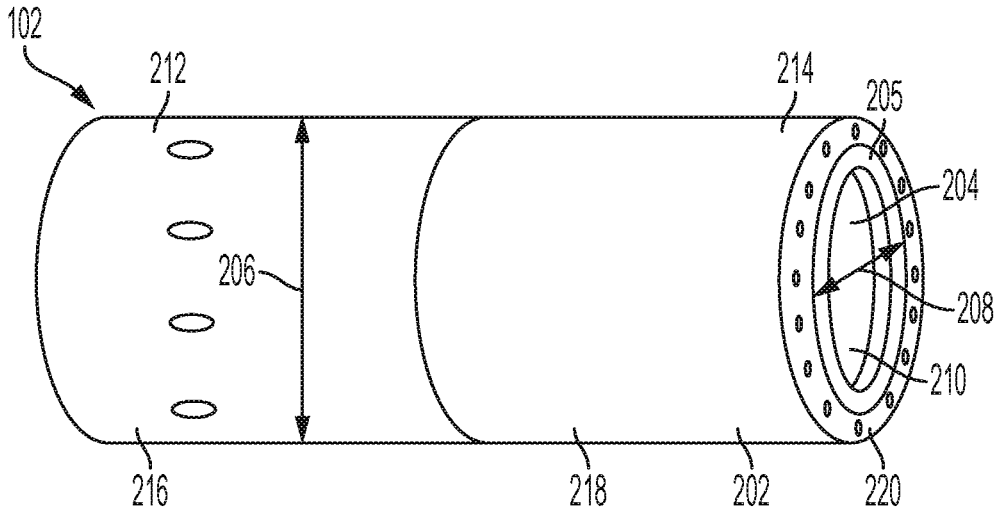
FIG. 2 is a perspective view of the tubular jetting device of FIG. 1 according to some aspects of the present disclosure.

In some examples, a catch basket 126 may be positioned to filter a fluid mixture received from exhaust openings of the tubular jetting device 102. For example, the catch basket 126 may be coupled with the work string 120 or with the tubular jetting device 102 uphole from the tubular jetting device 102, or the catch basket 126 may be independently positioned uphole from the tubular jetting device 102. In an example, the catch basket 126 includes a mesh or other filtering means that filters larger debris from the fluid mixture returning to the wellhead 106, FIG. 2 is a cross-sectional view of an additional example of the tubular jetting device 102 according to some aspects. The tubular jetting device 102 may be shaped to include an outer surface 202 and an inner surface 204. In some examples, the tubular jetting device 102 may be cylindrically shaped, though any other suitable shape may be used. The outer surface 202 may define an outer diameter 206 of the tubular jetting device 102 and the inner surface 204 may define an inner diameter 208 and a center bore 210 of the tubular jetting device 102.

The outer diameter 206 may be sized to fit the casing 118 or the wall of the wellbore 112 in which the tubular jetting device 102 is used. In some examples, the outer diameter 206 is sized to be in contact with the casing 118 or the wall of the wellbore 112. In further examples, the outer diameter 206 is sized such that there is a gap between the outer surface 202 and the casing 118 or the wall of the wellbore 112.

The inner diameter 208 may be sized to fit a variety of objects that may be present in the wellbore 112, including the downhole assembly 128, inside the tubular jetting device 102. For example, the inner diameter 208 may be sized such that the tubular jetting device 102 may pass over the downhole assembly 128. In some examples, the inner diameter 208 is sized such that the inner surface 204 is in contact with the downhole assembly 128 as the tubular jetting device 102 passes over the downhole assembly 128. In other examples, the inner diameter 208 is sized such that there is a gap between the inner surface 204 and the downhole assembly 128 when the downhole assembly 128, or at least a portion of the downhole assembly 128, is located inside the tubular jetting device 102. In such an arrangement where a gap is present between the inner surface 204 and the downhole assembly 128, a seal ring 205 may be located proximate to the inner surface 204. In some examples, the seal ring 205 may be coupled with the inner surface 204. The seal ring 205 may be sized to fill the gap between the inner surface 204 and the downhole assembly 128 to create a tight fit between the tubular jetting device 102 and the downhole assembly 128.

In some examples, the tubular jetting device 102 may include a first end 212 and a second end 214, where the first end 212 and the second end 214 are located at opposite ends of the tubular jetting device 102. The first end 212 may be located towards the uphole portion of the tubular jetting device 102 and may include an exhaust port portion 216. The second end 214 may be located towards the downhole portion of the tubular jetting device 102 and may include a ported jet portion 218. In some examples, the second end 214 may terminate at an end surface 220.

The exhaust port portion 216 and the ported jet portion 218 may be formed as a single unit or may be two separate portions that are either permanently or removably attached to each other. In such an example where the exhaust port portion 216 and the ported jet portion 218 are removably attached to each other, the two portions may be removably attached using a threaded connection, a system of fasteners, an adhesive, or any other suitable method of attachment.

Figure 3:
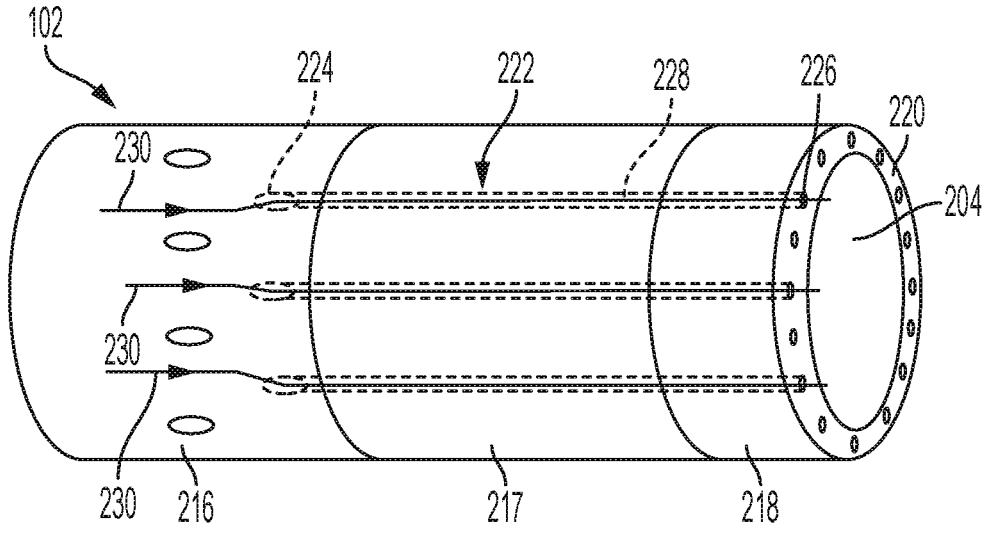
FIG. 3 is a perspective view of the tubular jetting device of FIGS. 1 and 2 with a fluid flowing through an inlet port according to some aspects of the present disclosure.

FIG. 3 is a cross-sectional view of an additional example of the tubular jetting device 102 according to some aspects. The tubular jetting device 102 may include at least one inlet port 222. But, the tubular jetting device 102 may include any suitable number of inlet ports 222. The inlet port 222 may include a first inlet opening 224, a second inlet opening 226, and an inlet channel 228. In some examples, the first inlet opening 224 may be disposed on the inner surface 204 of the tubular jetting device 102. For example, the first inlet opening 224 may be disposed on the inner surface 204 of the exhaust port portion 216. The second inlet opening 226 may be disposed on the end surface 220 of the ported jet portion 218. Additionally, the second inlet opening 226 may be fitted with a jet nozzle to reduce a flow area of the circulated fluid and focus the flow of the circulated fluid in a way that can agitate debris or deposits located in the wellbore.

In some examples, the inlet channel 228 extends between the first inlet opening 224 and the second inlet opening 226 to permit liquids to flow through the inlet port 222, as illustrated by arrows 230 and discussed further below with respect to FIGS. 5 and 6. The inlet channel 228 may be located between the outer surface 202 and the inner surface 204 of the tubular jetting device 102.

In some examples, it may be beneficial to adjust the length of the tubular jetting device 102. In such instances, an extension portion 217 may be coupled with the tubular jetting device 102. The extension portion 217 may be positioned to extend between the exhaust port portion 216 and the ported jet portion 218. The extension portion 217 may include a plurality of extension channels and openings that correspond with the inlet channels 228 so as to permit liquids to flow unobstructed through the extension portion 217. In some examples, the extension portion 217 may be coupled with only the exhaust port portion 216, only the ported jet portion 218, or both the exhaust port portion 216 and the ported jet portion 218. Additionally, the extension portion 217 may be removably attached to the tubular jetting device 102. For example, the extension portion 217 may attach to the exhaust port portion 216 or the ported jet portion 218 via a threaded connection. Any other suitable mechanism for removably attaching the extension portion 217 to the tubular jetting device 102 may be used.

Figure 4:
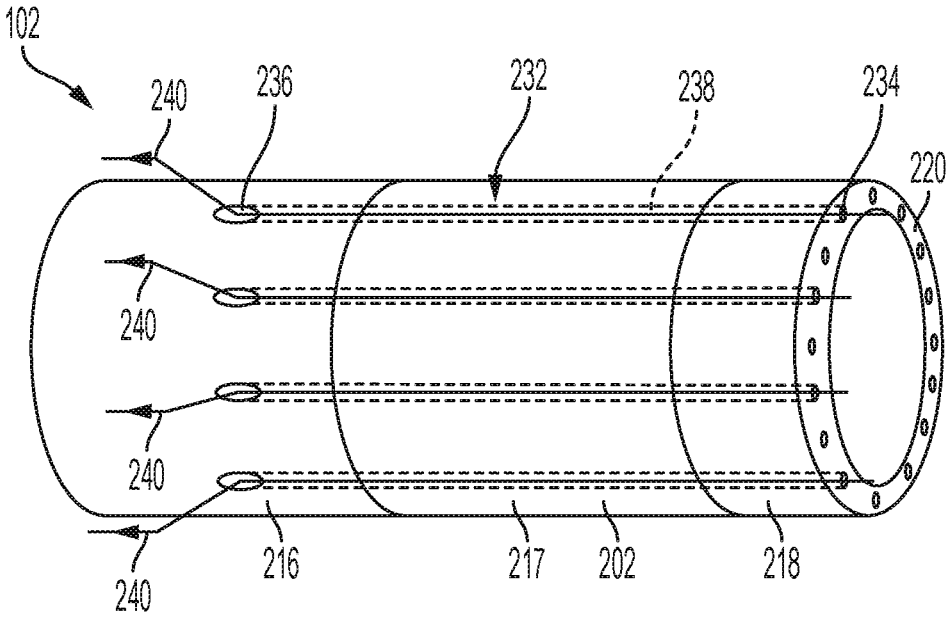
FIG. 4 is a perspective view of the tubular jetting device of FIGS. 1 and 2 with a fluid flowing through an exhaust port according to some aspects of the present disclosure.

FIG. 4 is a cross-sectional view of an additional example of the tubular jetting device 102 according to some aspects. The tubular jetting device 102 may include at least one exhaust port 232. But, the tubular jetting device 102 may include any suitable number of exhaust ports 232. The exhaust port 232 may include a first exhaust opening 234, a second exhaust opening 236, and an exhaust channel 238. In some examples, the first exhaust opening 234 may be disposed on the end surface 220 of the ported jet portion 218. The second exhaust opening 236 may be disposed on the outer surface 202 of the tubular jetting device 102. For example, the second exhaust opening 236 may be disposed on the outer surface 202 of the exhaust port portion 216.

In some examples, the exhaust channel 238 extends between the first exhaust opening 234 and the second exhaust opening 236 to permit liquids and debris to flow through the exhaust port 232, as illustrated by arrows 240 and discussed further below with respect to FIGS. 5 and 6. The exhaust channel 238 may be located between the outer surface 202 and the inner surface 204 of the tubular jetting device 200 and may be parallel to the inlet channel 228 discussed above with respect to FIG. 3. However, other orientations between the inlet channel 228 and the exhaust channel 238 are also contemplated.

Again, in some examples, it may be necessary or beneficial to adjust the length of the tubular jetting device 200. In such instances, the extension portion 217, discussed above with respect to FIG. 4, may be coupled with the tubular jetting device 200. The extension portion 217 may be coupled with the tubular jetting device so that it is positioned to extend between the exhaust port portion 216 and the ported jet portion 218. The extension portion 217 may include a plurality of extension channels and openings that correspond with both the inlet channels 228 and the exhaust channels 238 so as to permit liquids to flow unobstructed through the extension portion 217. As previously mentioned, the extension portion 217 may be coupled with only the exhaust port portion 216 or only the ported jet portion 218. Additionally, the extension portion 217 may be removably attached to the tubular jetting device 200. For example, the extension portion 217 may attach to the exhaust port portion 216 or the ported jet portion 218 via a threaded connection. Any other suitable mechanism for removably attaching the extension portion 217 to the tubular jetting device 200 may be used.

Figure 5:
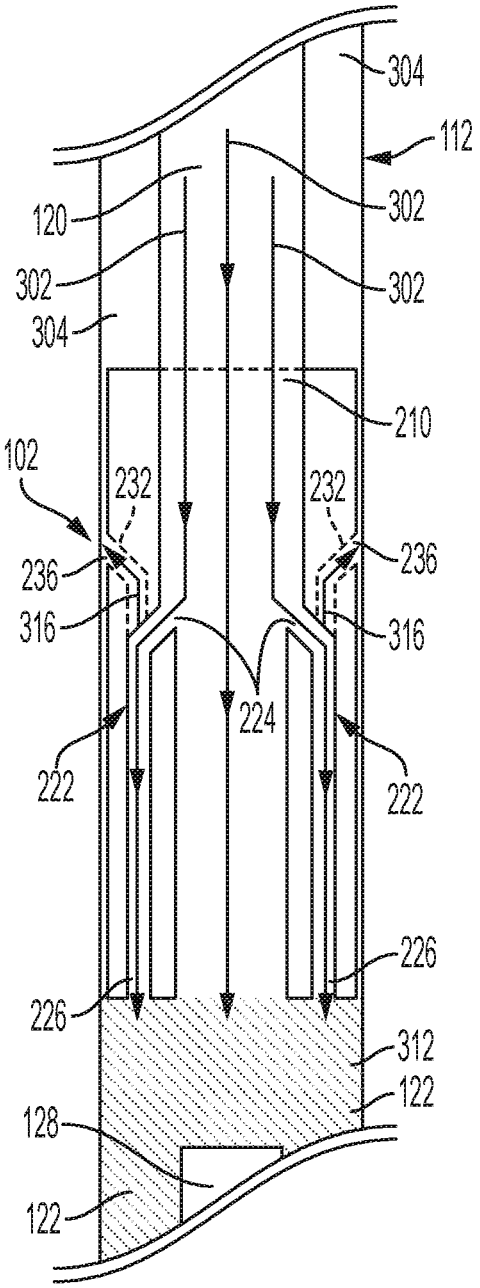
FIG. 5 is a cross-sectional view of the tubular jetting device of FIGS. 1 and 2 positioned above a downhole assembly in a wellbore according to some aspects of the present disclosure.
Figure 6:
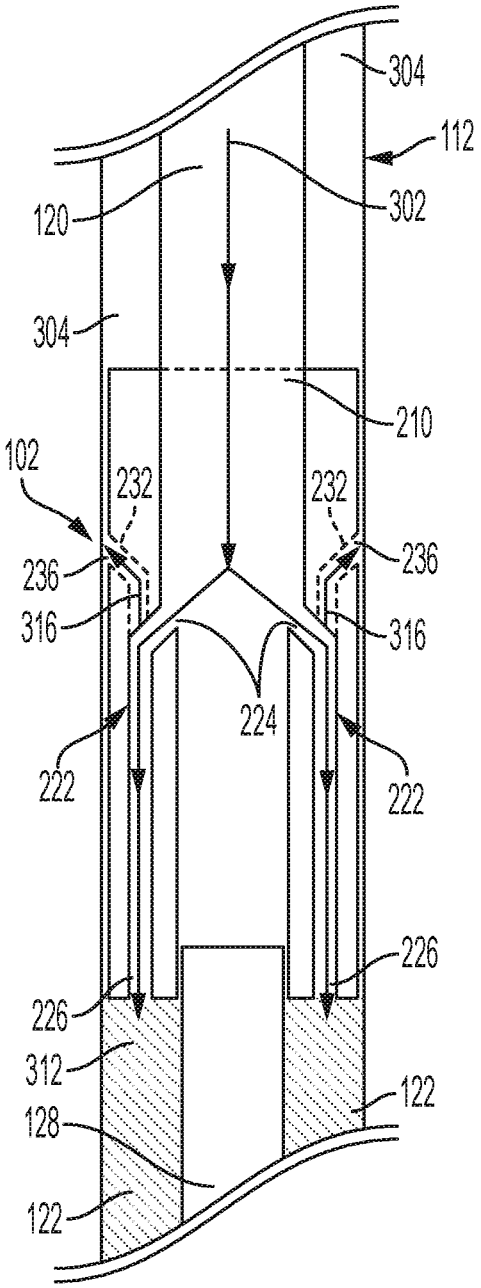
FIG. 6 is a cross-sectional view of the tubular jetting device of FIGS. 1 and 2 accepting the downhole assembly of FIG. 5 in the wellbore according to some aspects of the present disclosure.

FIGS. 5 and 6 are cross-sectional views of an additional example of the tubular jetting device 102 according to some aspects. The tubular jetting device 102 is depicted in use in the wellbore 112. The tubular jetting device 102 may be attached to the work string 120 that provides a liquid in a direction depicted by arrows 302 from an uphole location in the wellbore 112. As discussed previously, the liquid provided to the tubular jetting device 102 may be any suitable liquid for cleaning debris out of a wellbore (e.g., drilling mud, water, brine, etc.).

The tubular jetting device 102 may receive the liquid provided by the work string 120, and the liquid flows through the tubular jetting device 102. As may be seen in FIG. 5, when the center bore 210 of the tubular jetting device 102 is unoccupied (e.g., when the downhole assembly 128 is not positioned inside the center bore 210), the liquid may flow through the tubular jetting device 102 through the center bore 210, through the at least one inlet port 222, or both. It may be understood that the flow of the liquid through the tubular jetting device 102 may occur when the center bore 210 is only partially occupied as well. The pressure of the liquid flowing through the tubular jetting device 102 may result in an output of the liquid through at least one second inlet opening 226, through the center bore 210, or both.

As the liquid is output by the tubular jetting device 102, it mixes with debris and other liquids that may be present in the wellbore 112 to form a mixture 312. The mixture 312 may then be received by at least one first exhaust opening 234, which is described above in FIG. 4 but not shown in FIG. 5 or 6 to maintain the clarity of the other features, due to taking a path of least resistance. The mixture 312, as depicted by arrows 316, may travel through the exhaust port 232 and be output through the at least one second exhaust opening 236.

FIG. 6 shows the tubular jetting device 102 accepting the downhole assembly 128 into the center bore 210 where the downhole assembly 128 occupies the entire center bore 210 so as to completely obstruct the center bore 210. However, some examples, the downhole assembly 128 may only partially occupy the center bore 210. Due to the obstruction of the entire center bore 210, the liquid may be received by the at least one first inlet opening 224 and may only be output from the tubular jetting device 102 through the at least one second inlet opening 226. In those examples where the downhole assembly 128 only partially occupies the center bore 210, the liquid may be received by the first inlet openings 224 and the center bore 210, and the liquid may be output from the tubular jetting device 102 through the second inlet openings 226 and the center bore 210.

Figure 7:
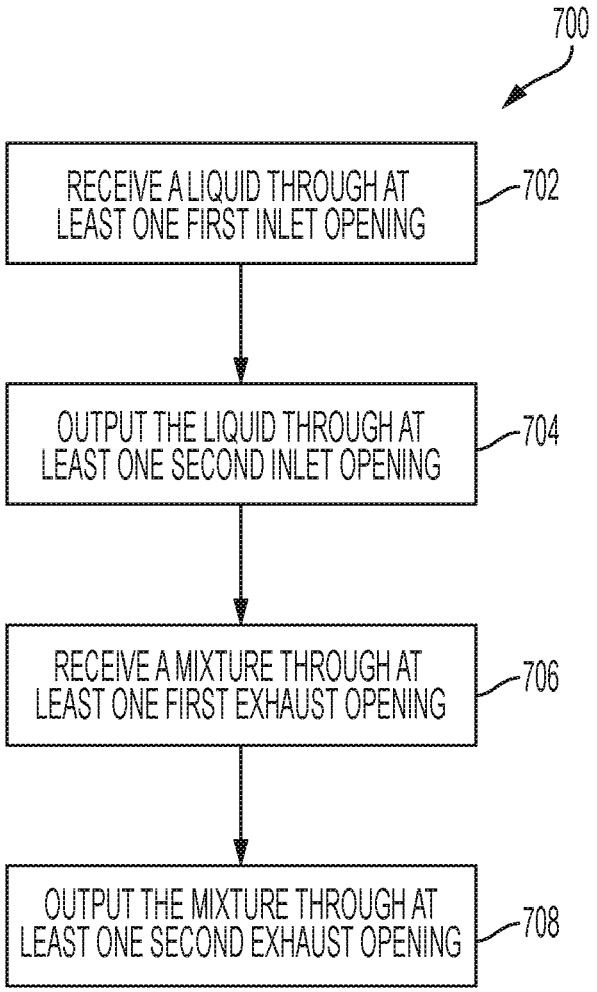
FIG. 7 is a flowchart of a process for using the tubular jetting devices of FIGS. 1-6 to clean debris from a wellbore according to some aspects of the present disclosure.

By permitting the liquid to flow primarily through the inlet ports 222 when the downhole assembly 128 occupies the entire center bore 210, the tubular jetting device 102 controls and diverts the flow of the liquid to jet specific areas. For example, the tubular jetting device 102 may jet and clean the debris found in the annulus 122 between the downhole assembly 128 and the wall of the wellbore 112. This cleaning occurs as a result of the liquid mixing with the debris to form the mixture 312. The mixture 312 is then received through at least one first exhaust opening 234 (not shown), travels uphole through the exhaust port 232 within tubular jetting device 102, and is output through the at least one second exhaust opening 236 to the annular area 304 above the tubular jetting device 102, FIG. 7 is a flowchart of a process 700 for using the tubular jetting device 102 to clean debris from a wellbore 112 according to some aspects of the present disclosure. At block 702, the process 700 involves receiving a liquid through at least one first inlet opening 224, where the first inlet opening 224 may be located in the inner surface 204 of the tubular jetting device 102. The liquid may be drilling mud, water, or brine. Other liquids are also contemplated based on a specific cleaning operation. Additionally, the liquid may be received through an unoccupied or only partially obstructed center bore 210 that is defined by the inner surface 204 of the tubular jetting device 102.

At block 704, the process 700 involves outputting the liquid through at least one second inlet opening 226 in the end surface 220 of the tubular jetting device 102. In some examples, the liquid may be output only through the second inlet openings 226 when the downhole assembly 128 is accepted into an inner diameter 208 of the tubular jetting device 102 such that the center bore 210 is completely obstructed. In such instances, outputting the liquid through the second inlet openings 226 results in outputting the liquid into the annulus 122 between the downhole assembly 128 and the wall of the wellbore 112. The flow of the liquid through the second inlet opening 226 will jet debris found in the annulus 122 between the downhole assembly 128 and the wall of the wellbore 112. The liquid may mix with the debris to form the mixture 312.

At block 706, the process 700 involves receiving the mixture 312 through at least one first exhaust opening 234 in the end surface of the tubular jetting device 102. The mixture 312 flows through the exhaust port 232 following the path of least resistance. Thus, at block 708, the process 700 involves outputting the mixture 312 through at least one second exhaust opening 236, where the second exhaust opening 236 is located in an outer surface 202 of the tubular jetting device 102. The mixture 312 is output to the annular area 304 uphole from the tubular jetting device 102 resulting in the debris found around the downhole assembly 128 being cleaned and removed from the area.

In some aspects, systems, devices, and methods for cleaning debris from a wellbore using a tubular jetting device are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a tubular jetting device comprising: at least one inlet port comprising: a first inlet opening in an inner surface of the tubular jetting device, wherein the inner surface defines a center bore; a second inlet opening in an end surface of the tubular jetting device; and an inlet channel extending between the first inlet opening and the second inlet opening; and at least one exhaust port comprising: a first exhaust opening in the end surface; a second exhaust opening in an outer surface of the tubular jetting device; and an exhaust channel extending between the first exhaust opening and the second exhaust opening.

Example 2 is the tubular jetting device of example 1, further comprising an exhaust port portion located at a first end of the tubular jetting device and a ported jet portion located at a second end opposite the first end and terminating at the end surface, wherein the first inlet opening is in the inner surface of the exhaust port portion and the second exhaust opening is in the outer surface of the exhaust port portion.

Example 3 is the tubular jetting device of example 2, wherein the exhaust port portion and the ported jet portion are removably attached to each other.

Example 4 is the tubular jetting device of examples 2 to 3, further comprising at least one extension portion extending between the exhaust port portion and the ported jet portion, wherein the at least one extension portion comprises a plurality of extension channels that correspond with the inlet channel of the at least one inlet port and the exhaust channel of the at least one exhaust port.

Example 5 is the tubular jetting device of example 4, wherein the exhaust port portion and the ported jet portion are removably attached to the extension portion.

Example 6 is the tubular jetting device of examples 4 to 5, wherein the tubular jetting device further comprises at least one seal ring proximate to the inner surface.

Example 7 is the tubular jetting device of examples 1 to 6, wherein the second inlet opening comprises a jet nozzle.

Example 8 is the tubular jetting device of examples 1 to 7, wherein the center bore is sized to pass over a downhole assembly in a wellbore.

Example 9 is a method comprising, receiving a liquid through at least one first inlet opening in an inner surface of a tubular jetting device; outputting the liquid through at least one second inlet opening in an end surface of the tubular jetting device; receiving a mixture through at least one first exhaust opening in the end surface of the tubular jetting device; and outputting the mixture through at feast one second exhaust opening in an outer surface of the tubular jetting device.

Example 10 is the method of example 9, wherein outputting the liquid through at least one second inlet opening in the end surface of the tubular jetting device comprises outputting the liquid into an annulus between a downhole assembly and a wall of a wellbore.

Example 11 is the method of examples 9 to 10, further comprising receiving and outputting the liquid through an unoccupied center bore defined by the inner surface of the tubular jetting device.

Example 12 is the method of examples 9 to 11, further comprising accepting a downhole assembly located in a wellbore into an inner diameter of the tubular jetting device.

Example 13 is the method of examples 9 to 12, wherein the tubular jetting device comprises a ported jet portion, an exhaust port portion, an inlet port, an exhaust port, or any combination thereof.

Example 14 is the method of examples 9 to 13, wherein the liquid comprises water, brine, or drilling mud and the mixture comprises the liquid and a plurality of debris.

Example 15 is a system comprising a tubing extending from a surface of a wellbore; a tubular jetting device joined to a downhole end of the tubing, the tubular jetting device comprising: an outer surface defining an outer diameter of the tubular jetting device; an inner surface defining an inner diameter and a center bore of the tubular jetting device; an exhaust port portion located at a first end; a ported jet portion located at a second end opposite the first end and terminating at an end surface; at least one inlet port comprising a first inlet opening in the inner surface of the exhaust port portion, a second inlet opening in the end surface, and an inlet channel extending between the first inlet opening and the second inlet opening; and at least one exhaust port comprising a first exhaust opening in the end surface, a second exhaust opening in the outer surface of the exhaust port portion, and an exhaust channel extending between the first exhaust opening and the second exhaust opening; and a catch basket positionable to filter a fluid mixture received from the second exhaust opening.

Example 16 is the system of example 15, wherein the tubing comprises a jointed pipe, coiled tubing, or transmission tubing.

Example 17 is the system of examples 15 to 16, wherein the catch basket is positioned uphole from the tubular jetting device.

Example 18 is the system of examples 15 to 17, wherein the tubing is positionable to transmit a liquid from the surface of the wellbore to the tubular jetting device so that the liquid travels through the inlet port from the first inlet opening to the second inlet opening to be output through the second inlet opening.

Example 19 is the system of example 18, wherein the liquid is mixable with a plurality of debris to form a mixture, and the exhaust port is positionable to receive the mixture at the first exhaust opening and enable output of the mixture through the second exhaust opening into an annulus between the tubing and a wall of the wellbore.

Example 20 is the system of examples 15 to 19, wherein the tubing and the tubular jetting device are removably coupled by a threaded connection.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A tubular jetting device comprising:

an exhaust port portion located at a first end of the tubular jetting device;

a ported jet portion located at a second end opposite the first end and terminating at an end surface of the tubular jetting device;

an inner surface of the tubular jetting device defining a center bore extending from the first end of the tubular jetting device to the second end of the tubular jetting device;

an outer surface of the tubular jetting device;

at least one inlet port comprising:

a first inlet opening in the inner surface of the exhaust portion of the tubular jetting device;

a second inlet opening in the end surface of the second end of the tubular jetting device; and an inlet channel extending between the first inlet opening and the second inlet opening; and at least one exhaust port comprising:

a first exhaust opening in the end surface;

a second exhaust opening in the outer surface of the exhaust port portion of the tubular jetting device; and an exhaust channel extending between the first exhaust opening and the second exhaust opening.

2. The tubular jetting device of claim 1, wherein the exhaust port portion and the ported jet portion are removably attached to each other.

3. The tubular jetting device of claim 1, further comprising at least one extension portion extending between the exhaust port portion and the ported jet portion, wherein the at least one extension portion comprises a plurality of extension channels that correspond with the inlet channel of the at least one inlet port and the exhaust channel of the at least one exhaust port.

4. The tubular jetting device of claim 3, wherein the exhaust port portion and the ported jet portion are removably attached to the extension portion.

5. The tubular jetting device of claim 3, wherein the tubular jetting device further comprises at least one seal ring proximate to the inner surface.

6. The tubular jetting device of claim 1, wherein the second inlet opening comprises a jet nozzle.

7. The tubular jetting device of claim 1, wherein the center bore is sized to pass over a downhole assembly in a wellbore.

8. A system comprising a tubing extending from a surface of a wellbore;

a tubular jetting device joined to a downhole end of the tubing, the tubular jetting device comprising:

an outer surface defining an outer diameter of the tubular jetting device;

an inner surface defining an inner diameter and a center bore of the tubular jetting device, wherein the center bore extends from a first end of the tubular jetting device to a second end opposite the first end;

an exhaust port portion located at the first end of the tubular jetting device;

a ported jet portion located at the second end of the tubular jetting device opposite the first end and terminating at an end surface;

at least one inlet port comprising a first inlet opening in the inner surface of the exhaust port portion, a second inlet opening in the end surface, and an inlet channel extending between the first inlet opening and the second inlet opening; and at least one exhaust port comprising a first exhaust opening in the end surface, a second exhaust opening in the outer surface of the exhaust port portion, and an exhaust channel extending between the first exhaust opening and the second exhaust opening; and a catch basket positionable to filter a fluid mixture received from the second exhaust opening.

9. The system of claim 8, wherein the tubing comprises a jointed pipe, coiled tubing, or transmission tubing.

10. The system of claim 8, wherein the catch basket is positioned uphole from the tubular jetting device.

11. The system of claim 8, wherein the tubing is positionable to transmit a liquid from the surface of the wellbore to the tubular jetting device so that the liquid travels through the inlet port from the first inlet opening to the second inlet opening to be output through the second inlet opening.

12. The system of claim 11, wherein the liquid is mixable with a plurality of debris to form a mixture, and the exhaust port is positionable to receive the mixture at the first exhaust opening and enable output of the mixture through the second exhaust opening into an annulus between the tubing and a wall of the wellbore.

13. The system of claim 8, wherein the tubing and the tubular jetting device are removably coupled by a threaded connection.

* * * * *